US005188264A

United States Patent [19]

Parkow et al.

[11] Patent Number: 5,188,264

[45] Date of Patent: Feb. 23, 1993

[54] RAILROAD HOPPER CAR DISCHARGE GATE VALVE

[75] Inventors: James C. Parkow, Geneva; Robert F. Seitz, Batavia, both of Ill.

[73] Assignee: Gen-Tech, Inc., North Aurora, Ill.

[21] Appl. No.: 756,478

[22] Filed: Sep. 9, 1991

[51] Int. Cl.[5] ..... B65G 53/46

[52] U.S. Cl. ..... 222/554; 406/128; 406/145

[58] Field of Search ..... 222/554–556, 222/185; 105/283; 406/128, 129, 131, 145; 251/144, 208, 299, 304, 305

[56] References Cited

U.S. PATENT DOCUMENTS

| | | | |
|---|---|---|---|
| 4,312,607 | 1/1982 | Van Auken | 222/554 X |
| 4,345,859 | 8/1982 | Robertson | 222/554 X |
| 4,411,560 | 10/1983 | McComb | 406/128 |
| 4,867,615 | 9/1989 | Fritz | 406/128 |
| 4,975,000 | 12/1990 | Fritz et al. | 406/128 |

*Primary Examiner*—Kevin P. Shaver
*Attorney, Agent, or Firm*—Kinzer, Plyer, Dorn, McEachran & Jambor

[57] ABSTRACT

A railroad hopper car discharge gate has slope sheets which terminate in a longitudinally extending lip, with the lips being spaced and there being a trough secured to the slope sheets beneath the spaced lips. Discharge from the gate is controlled by a rotatable longitudinal discharge valve shaft which extends between the lips of the slope sheets and is positioned to control flow from the gate interior above the slope sheets to the discharge trough. There is an operating handle for each end of the shaft, with the handles each being movable between a position in which the handle is locked on the shaft for rotation therewith, and a position in which the shaft is rotatable relative to the handle. There are stops positioned adjacent each handle for limiting rotation thereof. The valve shaft has a pair of axially spaced and axially extending recessed areas which are circumferentially non-aligned, but in part circumferentially overlapping. The handle stops permit rotation of the shaft by operation of only one handle between a fully closed position in which neither recess connects the gate interior with the discharge trough, two partially open positions in which one or another of the recesses connect the gate interior with the discharge trough, and a clean-out position in which one of the recesses is fully open and the other recess is partially open.

3 Claims, 5 Drawing Sheets

38
12
44
10
10
16
58
60
9
9
12
38

12
38
44
10
10
52
16
60
46
58
11
11
38
12
10
12
10
58
16
60
14
46

10
12
10
58
60
14
46
16

38
12
58
60
10
10
46
13
13
12
38

38
12
58
60
10
10
46
15
15
12
38
10
12
10
58
60
14
16
46

10
12
10
58
60
14
16
46

RAILROAD HOPPER CAR DISCHARGE GATE VALVE

SUMMARY OF THE INVENTION

The present invention relates to railroad hopper car discharge gates and specifically to the construction of the gate valve and the means for rotating it so that the gate valve may be operated from one side of the car to completely discharge the hopper car area serviced by the gate.

A primary purpose of the invention is a discharge gate of the type described having an improved valve construction and means for operating the valve construction which eliminates the necessity of operating the valve from both ends to completely empty the area of the hopper car serviced by the gate.

Another purpose is a discharge gate valve construction as described in which the valve may be rotated, from one side of the gate only, through positions which discharge all of the contents in the area serviced by the gate and further provide a cleanout position for use by service personnel.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
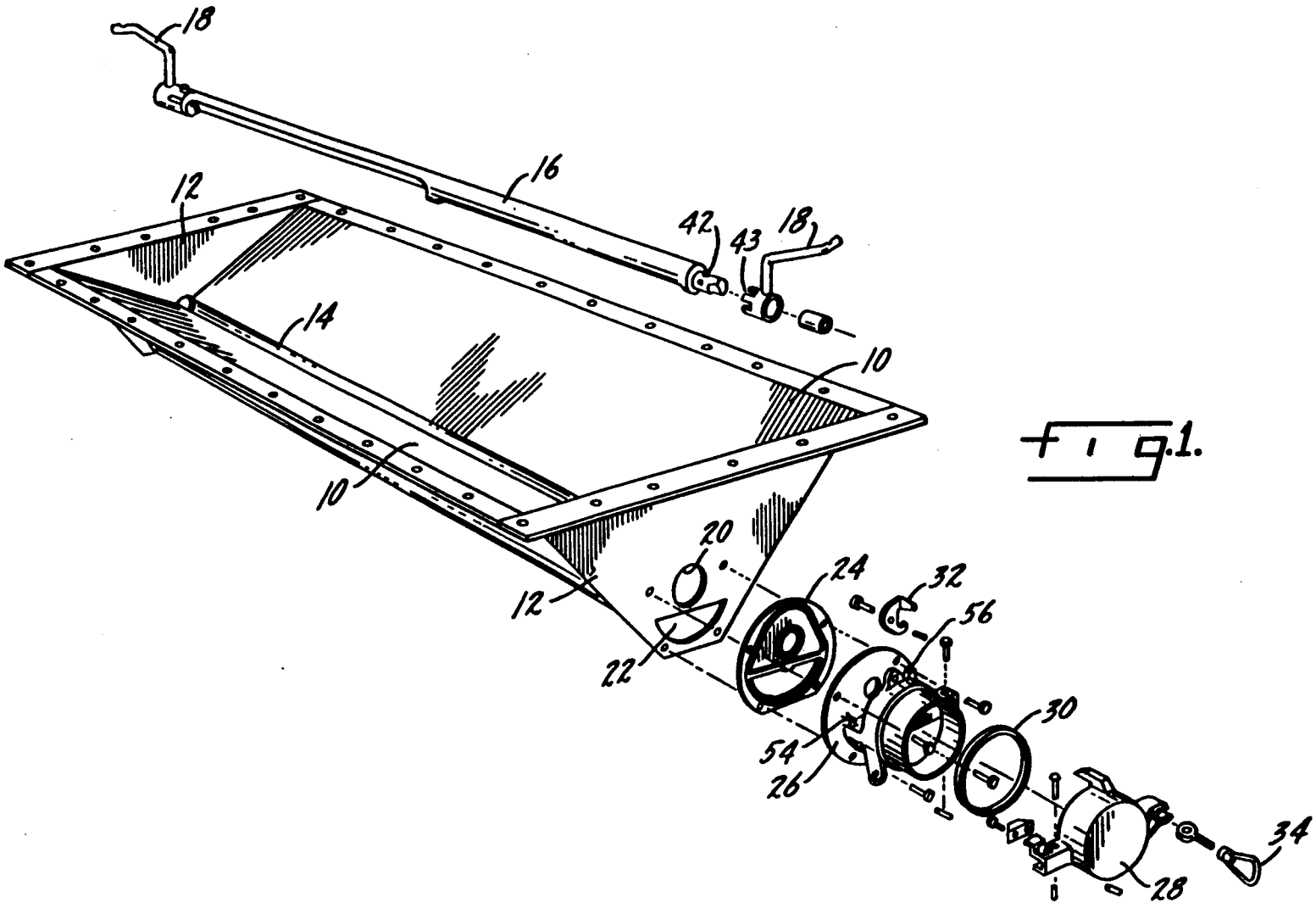
FIG. 1 is a perspective, in exploded form, illustrating the parts of the discharge gate of a railroad hopper car.

FIG. 1 illustrates the various parts of the outlet gate which form the discharge for a railroad hopper car. There will be several such gates in a conventional hopper car and the axis of the gates will be transverse to the longitudinal axis of the car. The gate includes slanted slope sheets 10 and end sheets or end plates 12 at opposite ends. There is a trough 14 which spans the space between the bottom edges of the slope sheets 10. The outlet gate has an identical discharge at each end and includes a valve shaft 16 operable from either end by handles 18. The shaft 16 extends through a shaft opening 20. There is a discharge opening 22 in each end plate. The end tube seal is indicated at 24 and is in contact with the end plate and has openings which are in alignment with shaft opening 20 and discharge opening 22. Positioned adjacent the end tube seal is the end tube 26 which has a cap 28 mounted thereto and a cap seal 30. There are various other parts to the end tube structure, including a shaft lock 32 and an eye bolt 34 which is used in locking valve shaft 16 in any one of a number of predetermined positions.

Conventionally, it is necessary to turn shaft 16 with the handles on both sides of the gate to unload a car. This requires that personnel doing the unloading crawl beneath the car or go around the car, either of which can be dangerous. The present invention provides a means for totally unloading and cleaning the car by manipulating the valve from just one side of the gate.

U.S. Pat. Nos. 4,867,615, 4,973,067, 4,974,999, 4,975,000 and 5,005,739 all show similar gate valves in which the valve shaft must be operated from both sides of the car to fully discharge and clean the gate.

As is known in the art (U.S. Pat. No. 4,345,859), valve shaft 16 is rotatable between several fixed positions. There is a fully closed position, which is the position during travel; a fully open position, which requires manipulation of the handles at each end of the valve; and two partially open positions, as well as a sample position. Normally, the fully open position is used by the operator to clean the gate after unloading. The present invention, by changing the position of the stops that control movement of the handle, permits total unloading and cleaning of the gate from only one end of the gate by the use of only one handle. It is not necessary for the operator to operate both handles, at opposite ends of the gate, to fully complete the unloading and cleaning operation. The present invention provides the described functions by changing the relative position of the handles and the stops for the handles at each end of the gate.

Figure 2:
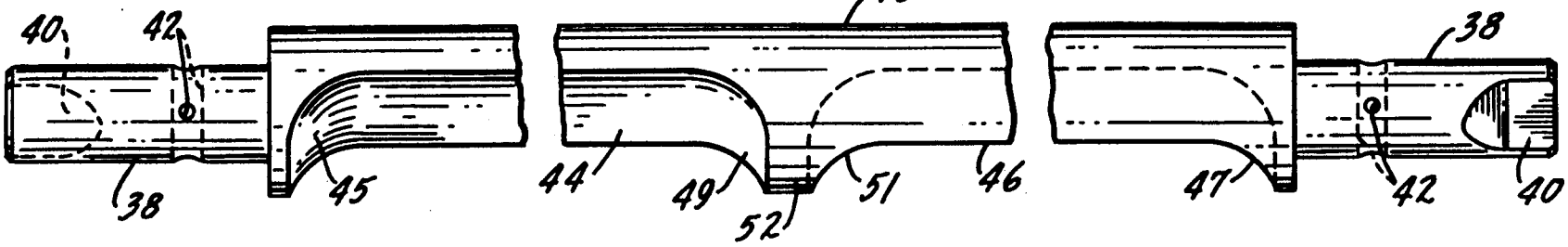
FIG. 2 is an enlarged side view, with portions removed, illustrating the discharge valve shaft of FIG. 1.

As illustrated in FIG. 2, valve shaft 16 has two axially extending and axially spaced recessed areas or discharge channels 44 and 46. Combined, channels 44 and 46 extend generally the entire length of the shaft between the end plates. Each of the channels terminates in a somewhat curved surface 45, 47 generally near the end of the shaft portion which is adjacent the end plates. At the center of the shaft there are similar curved surfaces 49, 51 which form the interior terminations of each of the channels. Between the curved surfaces 49, 51 there is a portion of the valve shaft, indicated at 52, which is unrecessed. This is both to separate the two channels or recessed areas and to provide added strength for the valve at its midpoint.

The stops which determine the degree of movement of each of the handles 18 are shown at 54 and 56 in FIG. 1. The handle 18 which may be in a latched position on shaft 16, or in an unlatched position, can turn either clockwise or counterclockwise between the stops 54 and 56. Locking pins will pass through holes 42 in the shaft and grooves 43 in the handles to latch the handles. In prior types of discharge gates of the type shown herein, in order to fully operate or unload the gate, not only was it necessary to use the handles at each end, but the handles had to be released from their locked or latched position, rotated relative to the valve shaft, and then relatched. The present invention avoids this necessity and, with the exception of full open, permits the full range of valve shaft movements with one handle latched in only one position.

Figure 3:
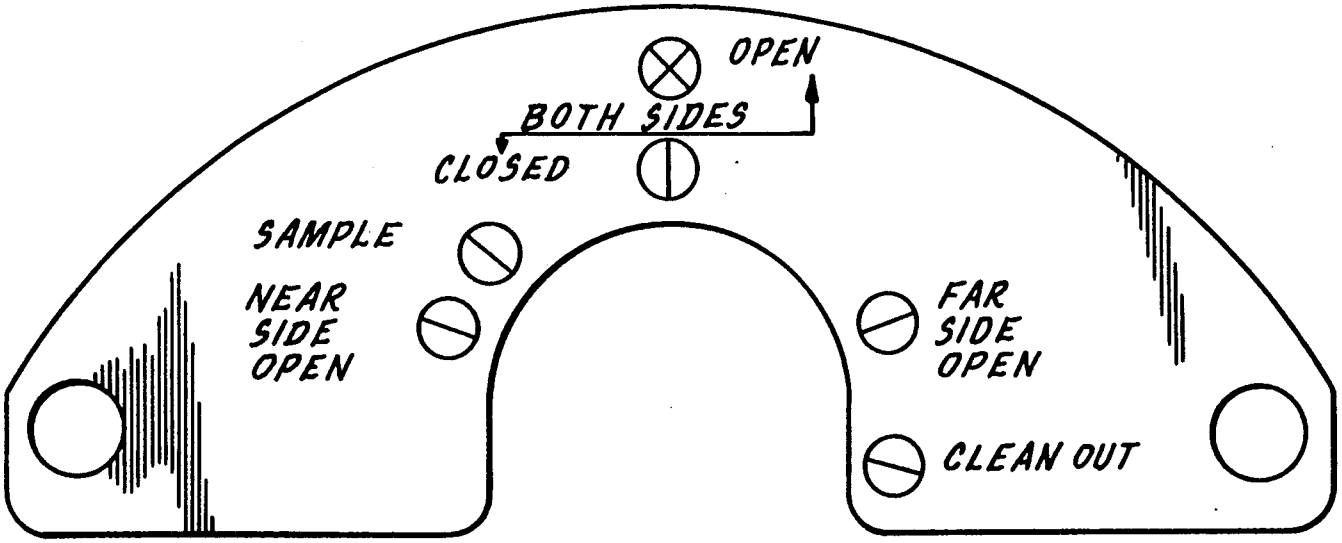
FIG. 3 is a plan view of the handle position decal used with the discharge gate valve.

FIG. 3 shows the decal which is on the end tube 26 and which shows the operator the various positions for the handle to provide certain discharge functions for the valve shaft. FIGS. 4 through 15 illustrate the specific positions of the valve shaft as seen from above it or the inside of the space between the slope sheets, as well as illustrating the relative position of the discharge channels and the lips of the slope sheets.

Figure 4:
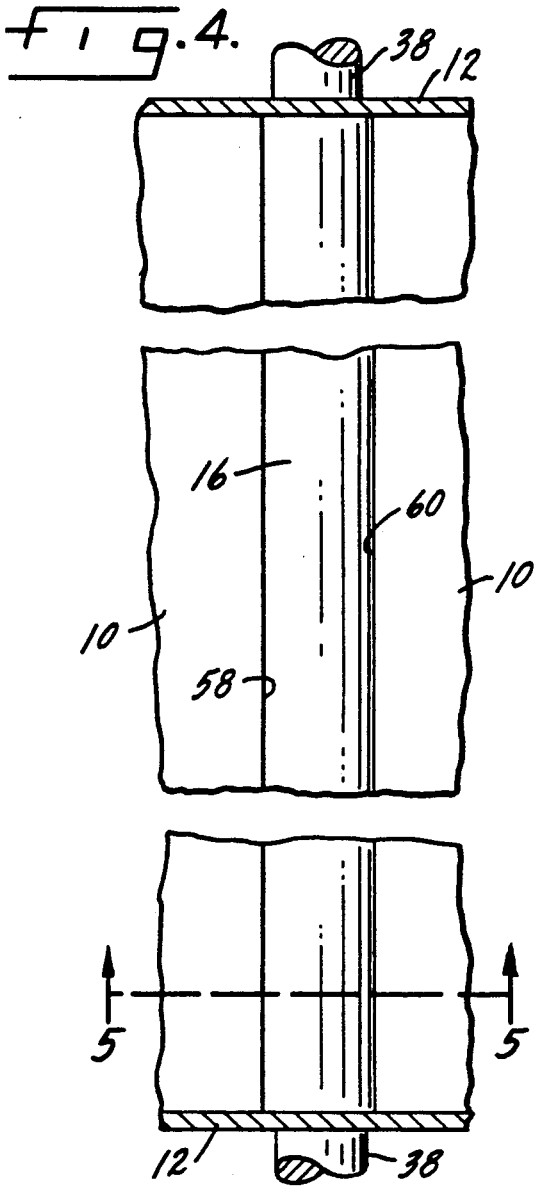
FIG. 4 is a partial top view showing the valve shaft of FIG. 2 in a fully closed position.
Figure 6:
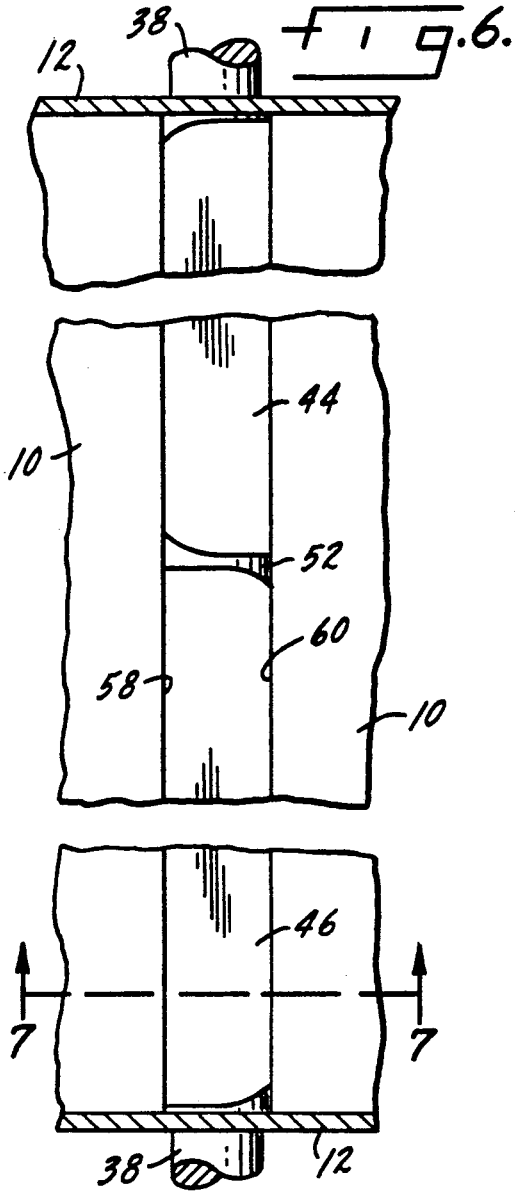
FIG. 6 is a partial top view, similar to FIG. 4, showing the valve shaft in a both-sides-open position.
Figure 5:
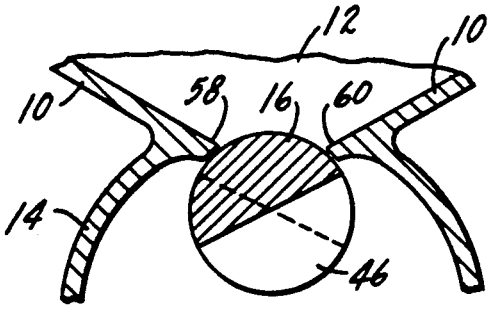
FIG. 5 is a section along plane 5—5 of FIG. 4.
Figure 7:
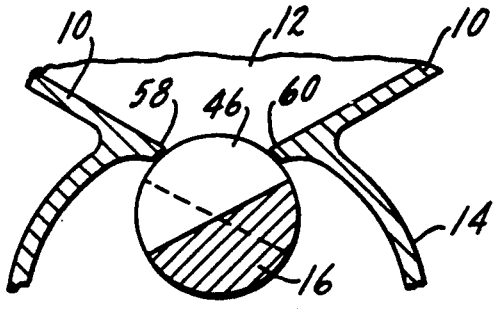
FIG. 7 is a section along plane 7—7 of FIG. 6.

FIGS. 4 and 5 illustrate the valve shaft in the closed position. Note that both of the channels face downwardly and that the lips 58 and 60 of the slope sheet are adjacent and above unrecessed areas of the valve shaft.

A second position of the valve shaft is what is described as the "both sides open" position. Both channels face upwardly to connect the area between the slope sheet with the trough beneath the slope sheets. Note particularly FIG. 7.

Figures 8, 9, 10, 11:
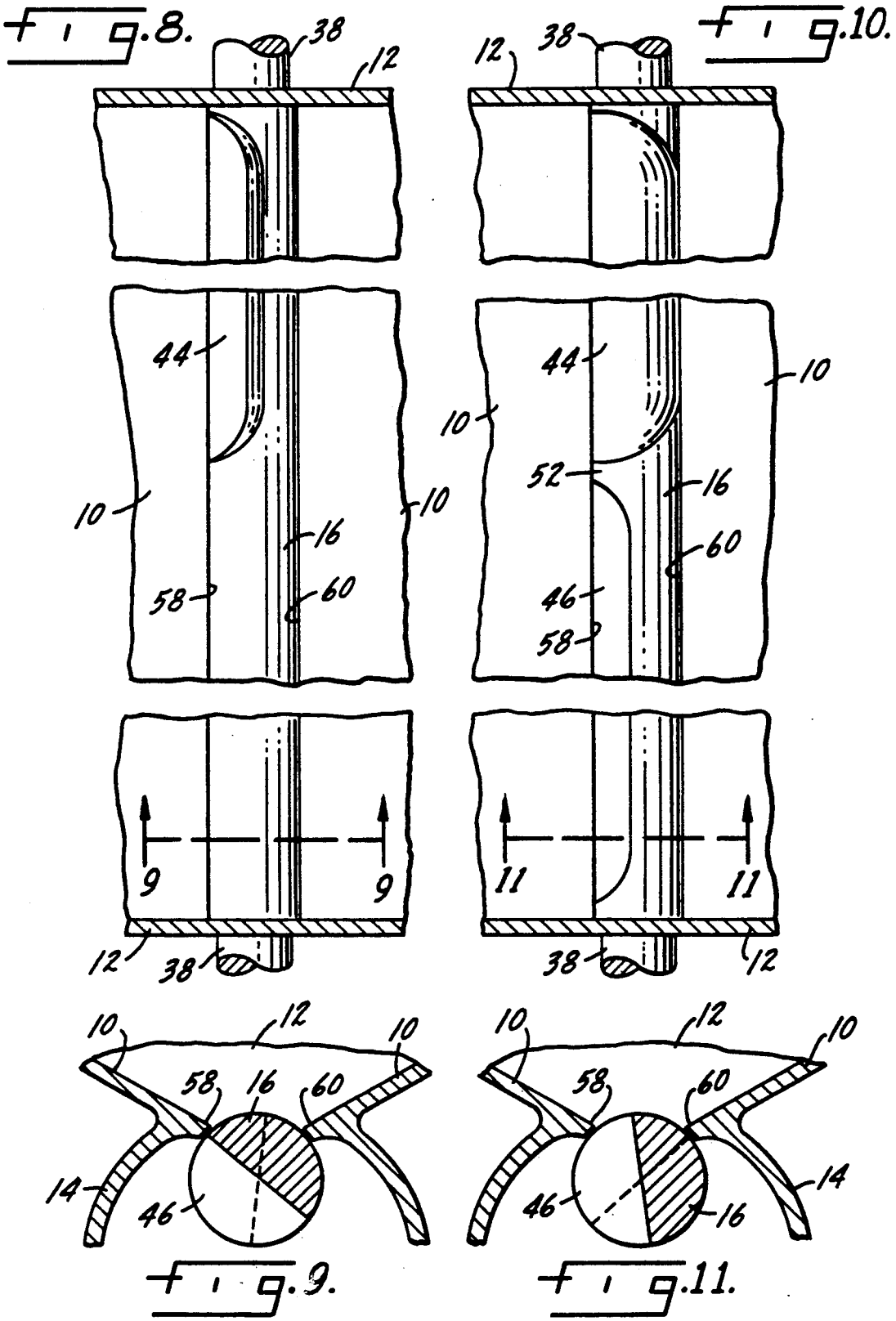
FIG. 8 is a partial top view, similar to FIGS. 4 and 6, showing the valve of FIG. 2 in a far-side-open position.
FIG. 9 is a section along plane 9—9 of FIG. 8.
FIG. 10 is a partial top view, similar to FIGS. 4, 6 and 8, showing the valve shaft in a cleanout position.
FIG. 11 is a section along plane 11—11 of FIG. 10.

FIGS. 8 and 9 illustrate the valve shaft in the far-side-open position. As is true with the other positions of the valve shaft, the handle which is operating the valve shaft will be aligned with the designation on the decal in FIG. 3 for that particular position of the shaft. The far side channel connects the space between the slope sheets with the underlying trough. The near side channel is closed.

FIGS. 10 and 11 illustrate the cleanout position. In this instance, the far side channel is totally open and the near side channel is partially open. This permits the entire gate to be subject to the vacuum applied at the end tube.

Figures 12, 13, 14, 15:
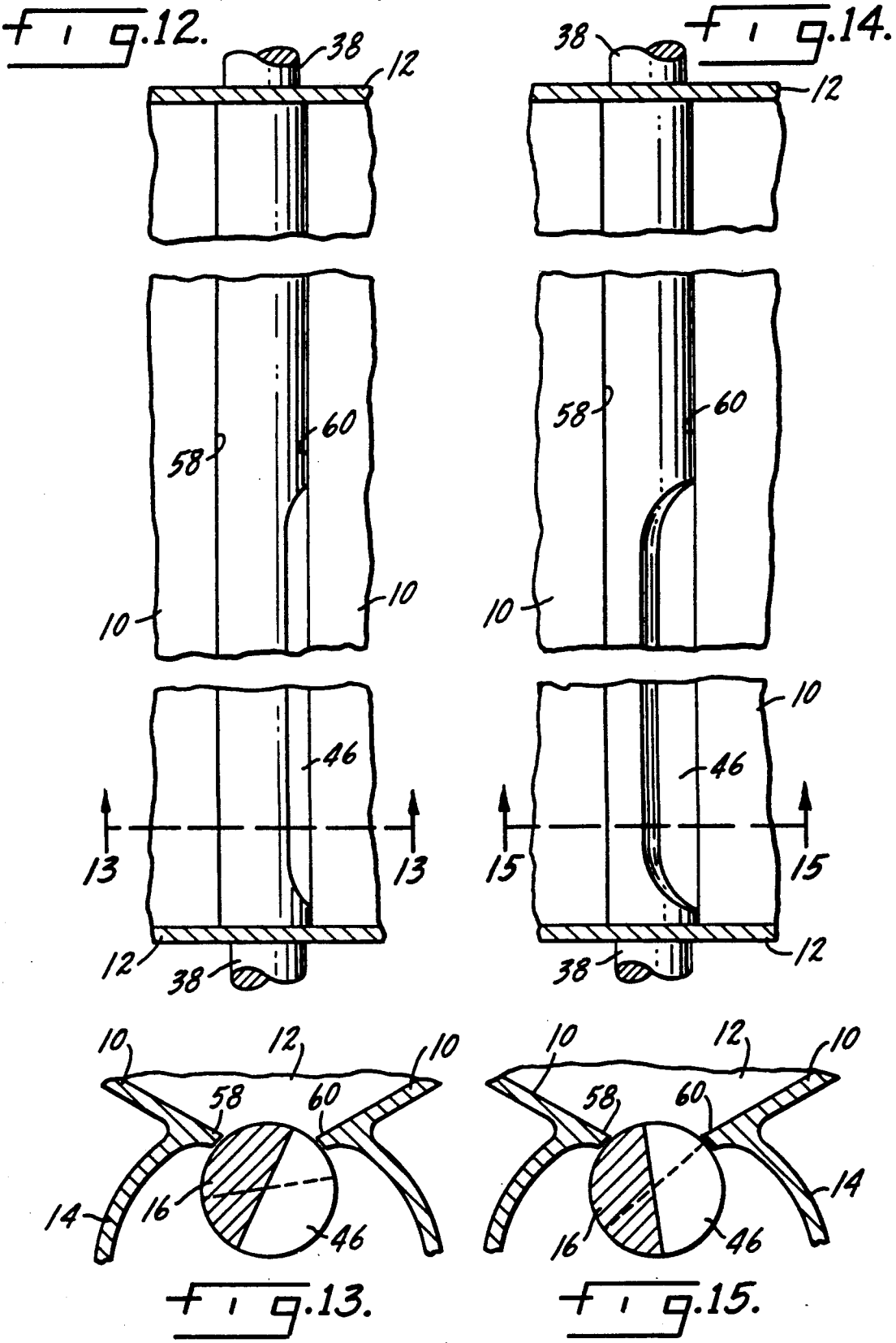
FIG. 12 is a partial top view, similar to FIGS. 4, 6, 8 and 10, showing the valve shaft in a sample open position.
FIG. 13 is a section along plane 13—13 of FIG. 12.
FIG. 14 is a partial top view, similar to FIGS. 4, 6, 8, 10 and 12, showing the valve shaft in a near-side-open position.
FIG. 15 is a section along plane 15—15 of FIG. 14.

FIGS. 12 and 13 show what is described as the "sample" position in which the near side channel is partially open. This is normally used when only a portion of the contents of the gate are to be discharged, principally for the purpose of taking a sample of the product therein.

FIGS. 14 and 15 show the near-side-open position. The far side channel is closed and the near side channel is fully open.

As indicated above, in prior unloading gates of this type it was necessary for the operator to manipulate the handles at each end of the gate. In unloading the gate disclosed herein, the operator may first place the handle in the far-side-open position. With the end cap open and a vacuum hose connected to the gate, a substantial portion of the contents will be discharged. To complete the unloading procedure the operator will then move the handle to the near-side-open position. In order to effect cleanout, the operator will move the handle to the cleanout position which will be permitted by the stop 56, which was not true of prior gates. When in the cleanout position, both the near side and far side will be open and the vacuum attached to the end tube will assure that no product remains within the gate. It is necessary for the channels on both the near and far sides to be simultaneously open to insure complete unloading and cleanout of all product within the gate.

Whereas the preferred form of the invention has been shown and described herein, it should be realized that there may be many modifications, substitutions and alterations thereto.

The embodiments of the invention in which an exclusive property or privilege is claimed are defined as follows:

1. A discharge gate for a railroad hopper car including slope sheets, each terminating in a longitudinally extending lip, said lips being spaced, and a trough secured to the slope sheets beneath the space between the lips, a rotatable longitudinal discharge valve shaft extending between the spaced lips of the slope sheets and positioned to control flow from the gate interior above the slope sheets to the discharge trough, an operating handle for each end of said shaft, said handles each being movable between a position in which the handle is locked on the shaft and a position in which the shaft is rotatable relative to the handle, stops positioned adjacent each handle for limiting rotation thereof, said shaft having a pair of axially spaced and axially extending recessed areas, said recessed areas being circumferentially non-aligned, but in part circumferentially overlapping, said handle stops limiting rotation of said shaft by operation of one handle only and without unlocking of said handle from said shaft between a full closed position in which neither recessed area connects the gate interior with the discharge trough; two partially open positions in which one or the other of said recessed areas connects the gate interior with the discharge trough, and a cleanout position in which one of said recessed areas is fully open to connect the gate interior with the discharge trough and the other recess is partially open to connect the gate interior partially with the discharge trough, when in said fully closed position the longitudinal edges of each recessed area being substantially circumferentially beyond and beneath the terminating spaced lips of the slope sheets.

2. The discharge gate of claim 1 further characterized in that each of said axially extending recessed areas extends an axial distance of approximately one-half of the shaft length between the longitudinal spaced lips of the slope sheets.

3. The discharge gate of claim 1 further characterized in that said shaft recessed areas are separated by an unrecessed area of said shaft.

* * * * *